US005356068A

United States Patent [19]

Moreno

[11] Patent Number: 5,356,068

[45] Date of Patent: Oct. 18, 1994

[54] FOIL-LIKE MATERIAL FOR A FOLDING PACK AND SUCH FOLDING PACK

[75] Inventor: Damaso Moreno, Huckelhoven, Fed. Rep. of Germany

[73] Assignee: Syspack, S.A., Frisbourg, Switzerland

[21] Appl. No.: 776,302

[22] PCT Filed: May 19, 1990

[86] PCT No.: PCT/EP90/00812

§ 371 Date: Nov. 8, 1991

§ 102(e) Date: Nov. 8, 1991

[87] PCT Pub. No.: WO90/14291

PCT Pub. Date: Nov. 29, 1990

[30] Foreign Application Priority Data

May 25, 1989 [DE] Fed. Rep. of Germany ..... 3917048

[51] Int. Cl.[5] ..... B65D 65/32

[52] U.S. Cl. ..... 229/87.05; 229/925; 229/926; 383/107; 383/200; 383/211

[58] Field of Search ..... 383/35, 100, 107, 66, 383/200, 201, 207, 208, 209, 210, 211; 229/87.05, 160.2, 924, 925, 926

[56] References Cited

U.S. PATENT DOCUMENTS

| | | | |
|---|---|---|---|
| 2,923,456 | 2/1960 | Ryan | 383/200 |
| 4,834,245 | 5/1989 | Ohga et al. | 383/201 |
| 4,964,515 | 10/1990 | Heyden | 383/107 |
| 5,011,014 | 4/1991 | Borck et al. | 383/210 X |
| 5,129,518 | 7/1992 | Tanaka et al. | 229/87.05 X |
| 5,184,771 | 2/1993 | Jud et al. | 229/87.05 |

FOREIGN PATENT DOCUMENTS

| | | | |
|---|---|---|---|
| 153468 | 6/1989 | Japan | 383/35 |
| 2216867 | 10/1989 | United Kingdom | 383/207 |
| 8702011 | 4/1987 | World Int. Prop. O. | 383/211 |

*Primary Examiner*—Allan N. Shoap
*Assistant Examiner*—Jes F. Pascua
*Attorney, Agent, or Firm*—Collard & Roe

[57] ABSTRACT

A folding pack (10) is produced from a single foil sheet (12) which is so folded round an article to be packaged and is so closed that the article is surrounded by it on all sides in an airtight manner. The closure is obtained by means of an adhesive bonding of the in each case mutually opposite edge regions of the foil sheet which laterally frame the inner region of the foil sheet. According to the invention, two mutually opposite edge regions (26, 28) each have at least one not permanently adhesive region (50, 60, 72, 74), these regions being located one above the other (24) in the state folded together to form a folding pack (10), and one of these two edge regions (50, 72) is partially separated materially along its peripheral line (54, 70, 52) from the remaining edge region (26). At the same time, the adhesive layers (40, 42) are respectively present between these two regions (50, 60 and 72, 74) and the inner region (22, 14, 16, 18, 20), in such a way that the inner region is completely framed laterally by the adhesive layers (40, 42).

5 Claims, 1 Drawing Sheet

FOIL-LIKE MATERIAL FOR A FOLDING PACK AND SUCH FOLDING PACK

FIELD OF THE INVENTION

The invention relates to a foil-like material for a folding pack and to a corresponding folding pack, in which the foil-like material is so folded round an article to be packaged and is so closed that the article is surrounded by it on all sides in an airtight manner. The foil-like material or the folding pack comprises a single foil sheet, of which the mutually opposite edge regions laterally framing the inner region of the foil sheet are each equipped with an adhesive layer.

Correspondingly produced folding packs serve for the packaging of, for example, freeze-dried coffee, biscuits, so-called sweet bars or other foodstuffs which are to be packaged in an airtight and moisture-proof or aroma-tight manner.

PRIOR ART

It is known to bring a single-ply, one-piece foil sheet together round the article to be packaged, in such a way that the foil sheet can be folded round the packaged article about bending edges extending in the direction of transport, the free seam edges subsequently being sealed to one another by means of a longitudinal seam. The sealed-together longitudinal-seam regions form a so-called longitudinal-seam fin which is subsequently swung round over its entire surface onto the outer face of the pack, so that it does not project disruptively from the pack. The two end faces of the pack are also sealed together in a similar way, so that the packaged article is thereafter closed on all sides by the foil sheet in an airtight, moisture-proof and aroma-tight manner.

The foil sheet itself consists, as a rule, of a composite material or of aluminium.

These known folding packs are satisfactory from a technical point of view. A disadvantage, however, is that they can be opened only with difficulty and that, without the aid of a cutting tool or without destroying the packaged article, opening is possible only with very great difficulty.

SUMMARY OF THE INVENTION

The object on which the invention is based is, whilst avoiding these disadvantages known from the state of the art, to provide a folding pack and the material used for this which make it possible to open folding packs of this type in an economically simple way, even without the aid of cutting tools, without difficulty and in a manner which takes good care of the packaged article.

The above object is achieved according to the present invention by providing a folding pack including a foil-like material, wherein the foil-like material is so folded around an article to be packaged and is so closed such that the article is surrounded by it on all sides in an airtight manner.

The folding pack according to the invention accordingly consists of a single foil sheet. The mutually opposite edge regions of this foil sheet which laterally frame the inner region of the latter are each equipped with an adhesive layer. The inner region itself, directly wrapping the article to be packaged, is not equipped with an adhesive layer. This foil sheet according to the invention is characterized in that the two mutually opposite edge regions each have at least one not permanently adhesive region, these regions of the two edge regions being located one above the other in the state folded together to form a folding pack. Furthermore, along the peripheral line of one of these two edge regions, the foil sheet is partially separated materially from the remaining edge region, the adhesive layers being present between these two not permanently adhesive regions and the respective adjacent inner region, so that the inner region is completely framed laterally by the adhesive layers. As in the state of the art, the article to be packaged is therefore framed on all sides by an adhesive layer, thus making it possible to obtain a sealed pack. Because one of the two edge regions located one above the other is materially separated and because these two regions are formed so as not to adhere to one another, it is possible to design the edge region with a tab located on one side, so that the folding pack can be opened very easily by pulling on this tab. This easy opening is achieved without any increase in the cost of material. Moreover, it is of essential importance for the economical utilization of this invention that the actual production of the pack, namely the wrapping of the foil sheet round the article to be packaged and the sealing together of longitudinal and end seams can be carried out in a similar way to that which is known from the prior art.

It is possible for this tab to be formed in various ways. Thus, the tab can be present completely within one of the two edge regions located one above the other, and this means that its peripheral line is completely within the corresponding edge region. But the tab can also be produced by means of one, especially two, edge incisions spaced from one another.

When the pack is being opened, the tab tears open the intermediate region between it and the inner region. When the pack is in the closed state, this intermediate region is equipped with an adhesive layer, since the article to be packaged must, of course, be closed on all sides. To make this tearing open simple and nevertheless to guarantee complete sealing in this intermediate region before tearing open, it has proved advantageous for the longitudinal structure of the glue coating in this intermediate region to be made parallel to the tearing-open direction.

Further features and advantages of the invention are to be taken from the features listed further in the claims and from the following exemplary embodiment.

BRIEF DESCRIPTION OF THE DRAWING

The invention is described in more detail and explained hereafter by reference to the exemplary embodiment illustrated in the drawing. In the drawing.

DETAILED DESCRIPTION

Figure 1:
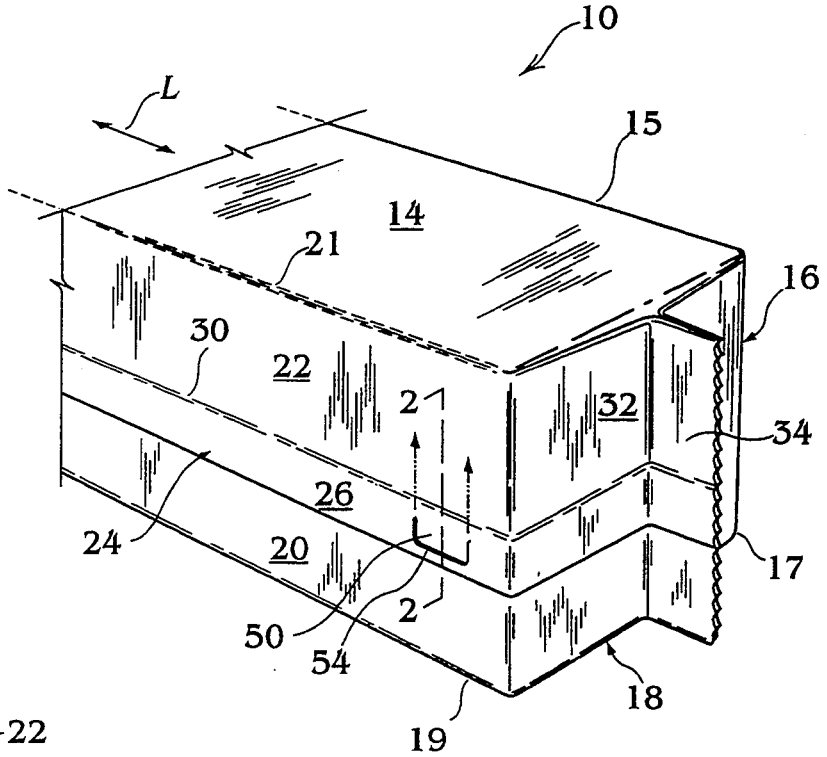
FIG. 1 shows a perspective part view of a folding pack according to the invention.
Figure 2:
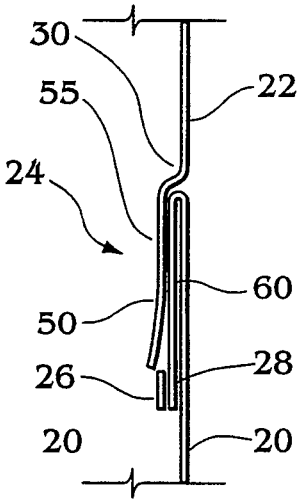
FIG. 2 shows a cross-section along the line 22 of FIG. 1.

A folding pack 10 according to the invention has a wrapping which is formed from a single foil sheet 12. This foil sheet 12 is shown in the form of a portion in the longitudinal direction L and unfolded in FIG. 3. The bending edges 15, 17, 19 and 21 formed respectively between the top side 14, rear side 16, bottom side 18 and the lower region 20 and upper region 22 of the front side on the pack 10 are represented by dot-and-dashed lines in FIG. 3. An inner region is made up of the five parts 14, 16, 18, 20 and 22 taken together.

On the folding pack 10 there is a so-called longitudinal-seam fin or edge fin 24 which is formed by the two outer longitudinal edge regions 26 and 28. In the state folded together to form the pack 10, these longitudinal edge regions 26, 28 are glued to one another. Along the bending edge 30 present between the longitudinal-seam fin 24 and the lower and upper region 20, 22 of the front side, the longitudinal-seam fin 24 is in the folded-round state, downwards in FIG. 1. This longitudinal-seam fin 24 also extends round the two end faces 32 of the pack 10 and is respectively fastened there to the end-seam fins 34 located there.

To produce the folding pack 10, the foil sheet 12 is equipped with an adhesive layer 40 and 42 in its longitudinal or opposite edge regions 26 and 28, that is to say in its edge regions adjoining the bending edge 30 outwards, as seen in cross-section. The region between the two bending edges 30 (FIG. 3) extending in the longitudinal direction L forms the inner region which rests directly against the article to be packaged and which is therefore not equipped with an adhesive layer.

Figure 3:
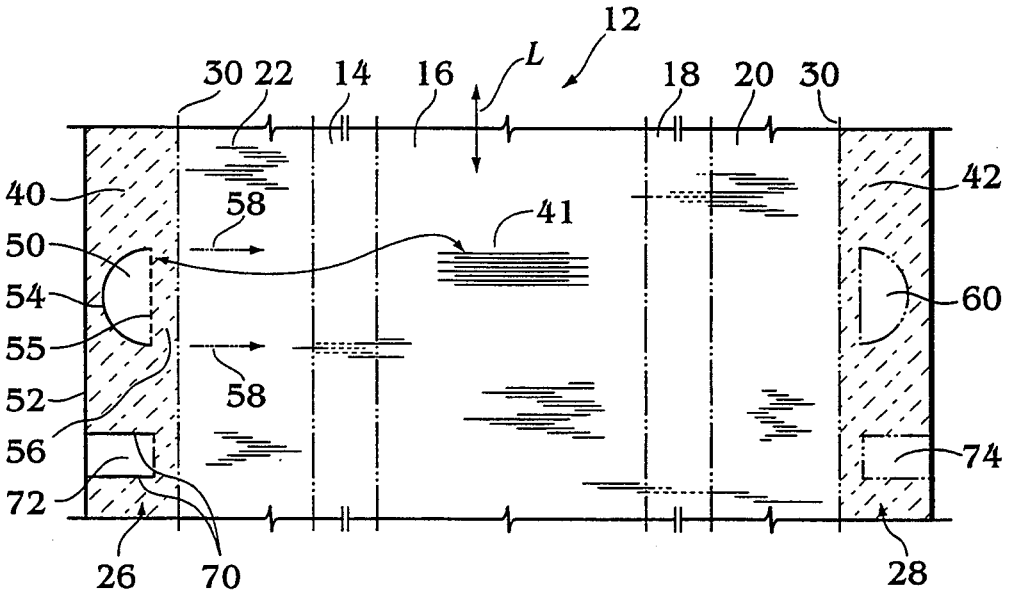
FIG. 3 shows a representation of a portion of the foil sheet from which the pack according to FIG. 1 is produced.

FIG. 3 shows the foil sheet 12 with its outer face, as it can be seen on the pack 10. The adhesive layers 40, 42 are thus located on the underside and, in the representation according to FIG. 3, would be invisible.

Within the adhesive layer 40 of the longitudinal edge region 26, on the left in FIG. 3 and visible as the upper edge region in the representation according to FIG. 1, an approximately semicircular part region 50 is free of the adhesive layer 40. The non-permanent adhesive part region 50 is framed towards the outer edge 52 by an approximately semicircular contour line 54, along which the foil sheet 12 is cut open. This contour line 54 therefore constitutes a cutting or punching line. The part region 50 thus forms a tab which is obtained by bending up this part region 50 out of the plane of the remaining foil sheet 12. The bending line 55 formed when this part region is swung up extends approximately parallel to the bending edge 30. The adhesive layer 40 is also present in the intermediate region 56 between the bending line 55 and the bending edge 30. At the same time, the adhesive layer or glue coating 40 has its longitudinal structure 41 so aligned that the longitudinal structure extends parallel to the tearing-open direction of the pack 10, that is to say parallel to the arrows 58. This can be achieved by a corresponding direction of coating of the adhesive layer 40 on the foil sheet. The part region 50 can thereby easily be torn open beyond the intermediate region 56 in the direction 58 and the pack 10 consequently opened.

The part region 60 of the other longitudinal edge region 28 present on the pack 10 underneath the part region 50 is likewise not equipped with an adhesive layer, whilst the remaining longitudinal edge region 28 round the part region 60 is equipped with the adhesive layer 42. In the representation according to FIG. 3, this adhesive layer 42 is also present on the underside of the foil sheet 12. When the foil Sheet 12 is in the folded-together state, the part region 60 free of an adhesive layer allows the part region 50 to be moved away from the part region 60, this being necessary in order to tear open the pack 10.

In the lower part region of the longitudinal edge regions 26, 28 of FIG. 3, another version of a tab design, not shown in FIG. 1, is illustrated. The part region 50 is formed not by a semicircular contour line 54, but by two cutting lines 70 in the longitudinal edge region 26 which are spaced from one another and which partially project from the outer edge 52 into the longitudinal edge region 26 equipped with an adhesive layer 40. The part region 72 between these cutting lines 70 corresponds in terms of effect to the part region 50. Accordingly, on the longitudinal edge region 28, a part region 74 corresponding in terms of effect to the part region 60 is likewise free of the adhesive layer 42. This part region 74 is at least as large as the part region 72, so that the part region 72, functioning as a tab, can be moved away from the part region 74 and the pack 10 correspondingly torn open. The tearing-open movement likewise runs parallel to the arrows 58 once again.

The abovementioned adhesive layers 40, 42 represent only one possibility of connecting the two longitudinal edge regions 26, 28 firmly to one another in a simple way. Instead of the two adhesive layers 40, 42, there could also be only a single adhesive layer 40 or 42. Furthermore, it would also be possible, for example, to make the firm connection by means of heat sealing. It remains important, at the same time, that a part region of one longitudinal edge region 26 or 28 should not be firmly connected to the corresponding other longitudinal edge region 28 or 26 and that it should be separated from the remaining longitudinal edge region by means of a separating line, so that a tab design can be formed on a seam fin of a pack.

I claim:

1. A foil-like material for folding around an article to be packaged, producing a folding pack comprising:

a single foil sheet having two opposite longitudinal edges and corresponding regions adjacent said edges, said regions laterally framing an inner region of the foil sheet, said single foil sheet being adapted to surround the article on all sides;

one of said regions having a tab, and the corresponding region containing a portion which has the configuration of the tab, said tab and said portion being located one above the other when said foil sheet is folded together to form a folding pack, said tab and said portion being disposed completely within the corresponding edge region;

an adhesive layer disposed on said regions surrounding said tab and said portion;

an intermediate region between each of said corresponding regions and the inner region;

said tab being partially separated materially along a peripheral line from the corresponding region, said adhesive layers being present respectively in the intermediate region between respective ones of said tab and said portion and the inner region, so that the inner region is completely framed laterally by said adhesive layers; and said partially separated tab being foldably connected to said intermediate region so that when said partially separated tab is pulled, the intermediate region is torn open.

2. The foil-like material according to claim 1, wherein the peripheral line along which the tab is separated is a continuous cutting line.

3. The foil-like material according to claim 1, further comprising:

said adhesive layer having a longitudinal structure;

a boundary line defining an edge for said inner region;

wherein at least in said intermediate region between said tab and said inner region, the longitudinal structure of said adhesive layer extends approximately perpendicularly relative to said boundary line edge for said inner region.

4. The foil-like material according to claim 1, wherein said single foil sheet forms an edge fin when said edge regions of said single foil sheet are joined together firmly, said two regions being adhered continuously to one another between said tabs and the inner space of the foil-like material, wherein said tabs are readily releasable from each other.

5. The foil-like material according to claim 4, wherein a fold line connecting the partially separated tab to the intermediate region is parallel to said longitudinal edge.

* * * * *